US006722998B1

(12) United States Patent
Miller

(10) Patent No.: US 6,722,998 B1
(45) Date of Patent: Apr. 20, 2004

(54) METHOD OF APPLYING PUTTER ALIGNMENT INDICATOR TO A PUTTER

(75) Inventor: Dale D. Miller, Dacula, GA (US)

(73) Assignee: Dale Miller Inc., Dacula, GA (US)

( * ) Notice: Subject to any disclaimer, the term of this patent is extended or adjusted under 35 U.S.C. 154(b) by 0 days.

(21) Appl. No.: 10/379,877

(22) Filed: Mar. 5, 2003

(51) Int. Cl.[7] ..... A63B 69/36

(52) U.S. Cl. ..... 473/209; 473/210; 473/220; 473/409; 473/249; 473/251; 473/242

(58) Field of Search ..... 473/220, 221, 473/222, 223, 224, 225, 219, 251, 131, 226, 238, 231, 242, 257, 268, 274, 210, 409, 209, 249

(56) References Cited

U.S. PATENT DOCUMENTS 4,303,244 A * 12/1981 Uppvall ..... 473/409
4,327,918 A * 5/1982 Foster ..... 473/221
4,928,971 A 5/1990 Soles, Jr.
5,174,573 A 12/1992 Desbiolles et al.
5,388,831 A * 2/1995 Quadri et al. ..... 473/220
5,564,990 A 10/1996 Weeks
5,800,278 A * 9/1998 Varriano ..... 473/209
5,879,239 A * 3/1999 Macroglou ..... 473/209
6,149,531 A * 11/2000 Hooker ..... 473/220
6,379,258 B1 4/2002 To
6,409,610 B1 6/2002 Ahn et al.
6,422,949 B1 7/2002 Byrne et al.

* cited by examiner

*Primary Examiner*—Sebastiano Passaniti
(74) *Attorney, Agent, or Firm*—Andrus, Sceales, Starke & Sawall, LLP

(57) ABSTRACT

A method for applying a putter alignment indicator to a putter to aid in aligning the putter during a putting stroke. The method includes providing a substantially planar alignment surface and having a golfer, while standing in the golfer's normal putting stance, place the striking surface of the putter head against the substantially planar alignment surface. A light source directs a beam of light onto the elongated shaft to create a shadow on the heel portion of the putter head. The position of the light source is adjusted until the first edge and the second edge of the shadow, as viewed by the golfer when standing in the golfer's normal putting stance, appear adjacent to or directly behind the shaft. An alignment indicator is applied to the putter head adjacent to at least one edge of the shadow.

24 Claims, 4 Drawing Sheets

METHOD OF APPLYING PUTTER ALIGNMENT INDICATOR TO A PUTTER

BACKGROUND OF THE INVENTION

The present invention generally relates to the game of golf. More particularly, the present invention relates to a method of applying alignment indicator(s) to a putter to aid in aligning the putter during a putting stroke.

Accurate putting is an important part of a successful round of golf. Before executing an accurate putt, a golfer must properly align the head of a putter relative to a ball and in view of an intended line of putt. The slightest inaccuracy in putter head alignment can undesirably result in an inaccurate or missed putt. The ramifications of inaccurate putter head alignment are further magnified as the terrain of the putting surface becomes more undulating and as the distance of the ball to an intended target increases. Therefore, any inaccuracy in putter head alignment is undesirable because it can lead to inaccurate putts and ultimately to an undesirably high golf score.

The golf industry has provided putters having uniform or standard alignment devices to assist golfers with putting, and specifically to help golfers accurately align the putter head during a putting stroke. One example is set forth in U.S. Pat. No. 4,928,971, which discloses an alignment system that provides markings on a putter head. The markings include a series of lines and a conical depression. Another example is the putter head disclosed in U.S. Pat. No. 5,564,990, wherein alignment markings are provided on a putter head which comprise two parallel lines that border a circular marking which is screened from view if the golfer is properly aligned with a ball to be putted.

The golf industry has also provided methods for aligning a golf ball with a standard golf club design. An example is U.S. Pat. No. 6,379,258 which discloses a method of aligning a golf ball with a golf club having predetermined alignment indicia. The alignment indicia are in the form of a first straight line and a second straight line positioned in spaced-apart relation on the top of the club head. The first straight line and the second straight line diverge as they approach the striking face. By selecting the first straight line or the second straight line for alignment, the striking face of the club is moved to an open or closed position to aid in intentional placement of the golf ball from left or right toward a selected target.

However, the prior art fails to address the fact that each golfer's individual physical characteristics and putting style are unique and therefore each golfer addresses a ball to be putted in a unique way. Each golfer's perception of a correct line of putting is different depending on the golfer's height, physique, and stance. The prior art uniform or standard alignment devices and methods to assist golfers with putting are not tuned to the individual golfer's unique stance and stroke and can therefore be of little help to the golfer. Standard devices and methods may also undesirably require an individual golfer to change his or her swing or stance in order to utilize the alignment device or methods.

Therefore it is desirable to provide a simple, personalized method for applying a putter alignment indicator to a putter to aid in aligning the putter during a putting stroke.

SUMMARY OF THE INVENTION

The present invention provides a desirable, simple, personalized method for applying a putter alignment indicator to a putter head to aid in aligning the putter during a putting stroke.

The method includes having a golfer to be fitted grasp the first end of a putter. While standing in the golfer's normal putting stance, the golfer places the striking surface of the putter head against a substantially planar alignment surface. A light source is positioned to direct a beam of light onto the shaft to cast a shadow on the heel portion of the putter head such that a first edge and a second edge of the shadow, as viewed by the golfer when standing in the golfer's normal putting stance, appear adjacent to the tubular outer edges of the shaft or directly behind the shaft. An alignment indicator is then placed on the putter head adjacent to at least one edge of the shadow.

By the method of the present invention, a personalized alignment indicator is applied to the putter head which, as viewed by the individual golfer when standing in the golfer's normal putting stance, allows the golfer to properly align the putter during future putting strokes. Specifically, when the golfer addresses a ball to be putted, the golfer adjusts the position of the putter head until the alignment indicator on the heel of the putter head appear adjacent to or directly behind the club shaft.

BRIEF DESCRIPTION OF THE DRAWINGS

The drawings illustrate the best mode presently contemplated of carrying out the present invention.

In the drawings.

DETAILED DESCRIPTION OF THE PREFERRED EMBODIMENTS

In the preferred embodiment of the method of the present invention described in detail below, at least one putter alignment indicator is applied to a putter to aid in aligning the putter during a putting stroke.

Figure 1:
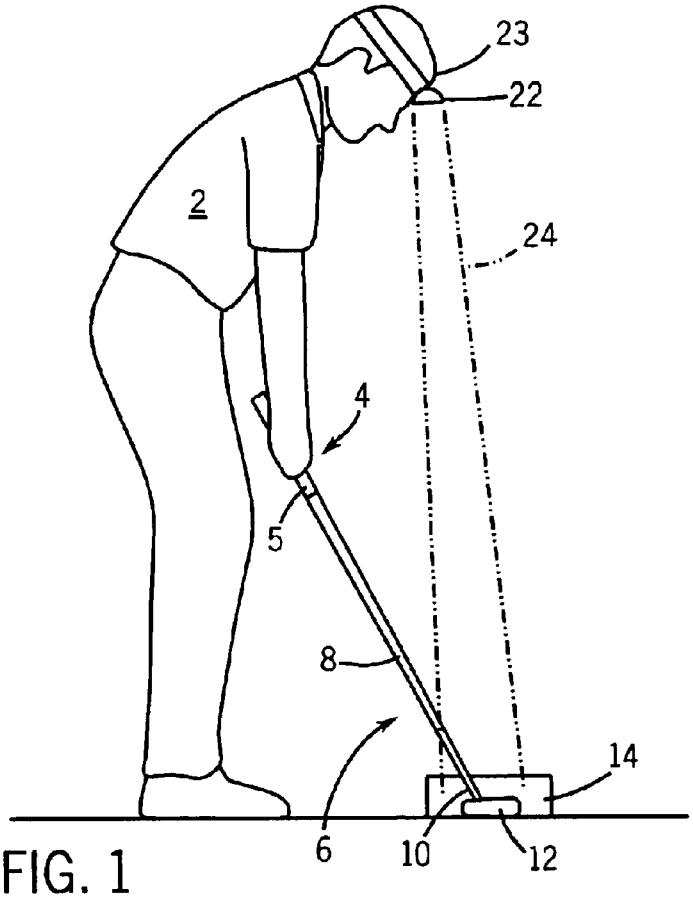
FIG. 1 is a side view of a golfer standing in the golfer's normal putting stance, grasping a first end of the club shaft, and placing the putter head against a substantially planar alignment surface.

As shown in FIG. 1, a golfer 2 to be fitted grasps a first end 4 of a putter while standing in the golfer's normal putting stance. Typically, the first end 4 includes a grip 5. The putter has an elongated shaft 8 extending between the first end 4 and a second end 10. The second end 10 of the shaft includes a putter head 12 for striking a golf ball using a putting stroke. While taking the normal stance, the golfer 2 places the putter head 12 against a substantially planar alignment surface 14.

Figure 2:
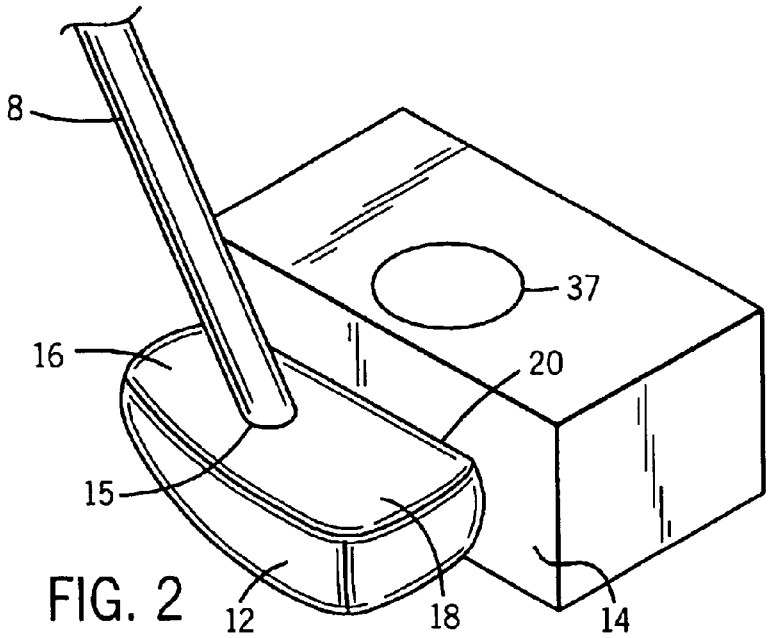
FIG. 2 is a view in perspective of the putter head aligned against the substantially planar alignment surface.

As can be seen more clearly in FIG. 2, the elongated shaft 8 of the putter 6 is coupled to the putter head 12 at a junction 15. The putter head 12 has a heel portion 16 and a toe portion 18 on opposite sides of the junction 14. The putter shown in FIG. 2 is referred to as a center-shaften putter since the junction 15 is between the heel 16 and the toe 18. The putter head 12 also has a generally planar striking surface for striking a ball (not shown). In the particular embodiment of the method depicted in FIGS. 1 and 2, it is preferable that the golfer 2 places the striking surface 20 of the putter head 12 flush against the substantially planar alignment surface 14.

Figure 3:
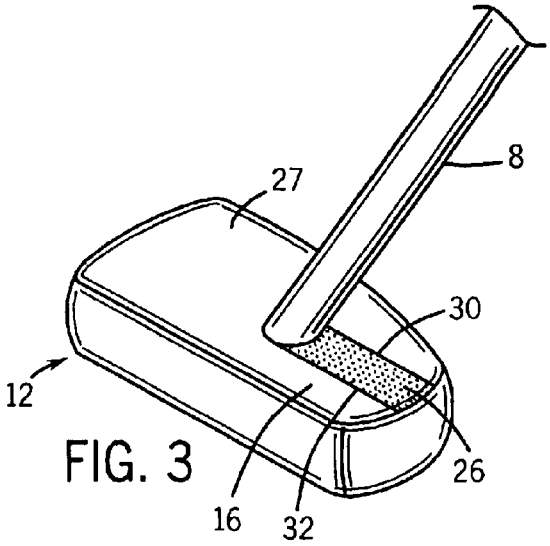
FIG. 3 is a view in perspective of a shadow cast on a heel portion of the putter head.

Referring to FIG. 1, a light source 22 is used to direct a beam of light 24 across the elongated shaft 8 and onto the putter head 12. As shown in FIG. 3, the beam of light 24 passes across the elongated shaft 8 and creates a shadow 26 on the top surface 27 of the putter at the heel portion 16 of the putter head 12. In the particular embodiment shown in FIG. 1, the light source 22 is preferably coupled to the golfer's forehead 23. This ensures that the light source 22 is positioned at a point substantially parallel to the golfer's line of sight when the golfer has taken a normal putting stance. As will be described in detail below, it is not essential that the light source 22 be coupled to the golfer 2 or that the light source 22 be located along the golfer's line of sight. However, the light source 22 should be positioned so that a first edge 30 and a second edge 32 of the shadow 26, as seen by the golfer 2, appear substantially adjacent to, or are hidden behind the elongated shaft 8.

Figure 4:
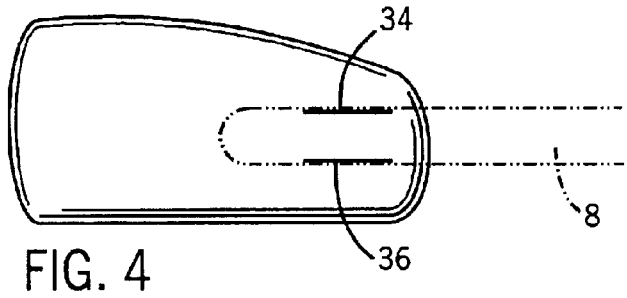
FIG. 4 is the putter head as viewed by the golfer when standing in the golfer's normal putting stance, the head having at least one alignment indicator adjacent the shaft on the heel portion.
Figure 4A:
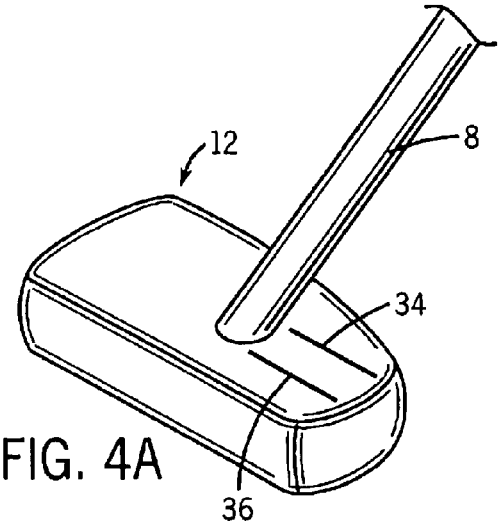
FIG. 4A is a perspective view of the putter head shown in FIG. 4.

Referring now to FIGS. 4 and 4A, a next step of the method of the present invention comprises placing at least one alignment indicator on the putter head adjacent the first and second edges 30, 32 of the shadow 26 while the golfer is taking a normal putting stance. In the embodiment shown in FIG. 4, a pair of alignment indicators 34, 36 are parallel lines marked adjacent to the elongated putter shaft 8 as viewed by the golfer 2 when standing in the golfer's normal putting stance. Once applied, the alignment indicators 34 and 36 aid the golfer 2 in aligning the putter during future putting strokes. When the golfer 2 addresses a ball to be putted, proper alignment of the putter 12 is easily attained by ensuring that the alignment indicators 34, 36, as viewed by the golfer 2 when standing in the golfer's normal putting stance, appear adjacent to or hidden behind the elongated putter shaft 8. Specifically, when the golfer 2 addresses a ball to be putted, the golfer 2 ensures that the putter 6 is correctly aligned in view of an intended line of putt by adjusting the position of the putter head 12 until the alignment indicators 34 and 36 appear adjacent to or hidden behind the club shaft.

In the particular embodiment shown in FIGS. 1 and 2, the substantially planar alignment surface 14 indicates the position of a ball to be putted. The indicator comprises a marking 37 on the top 39 of the planar surface. The marking 37 has a diameter substantially equal to a diameter of a golf ball. It should be recognized from the embodiment described above that the substantially planar alignment surface 14 is not limited to the embodiment depicted in FIGS. 1 and 2. The alignment surface does not have to indicate the position of a ball to be putted. Any surface will suffice that is substantially planar and is substantially parallel to the striking surface 20 of the putter head 12, as held by the golfer 2 while standing in the golfer's normal putting stance.

Figure 5:
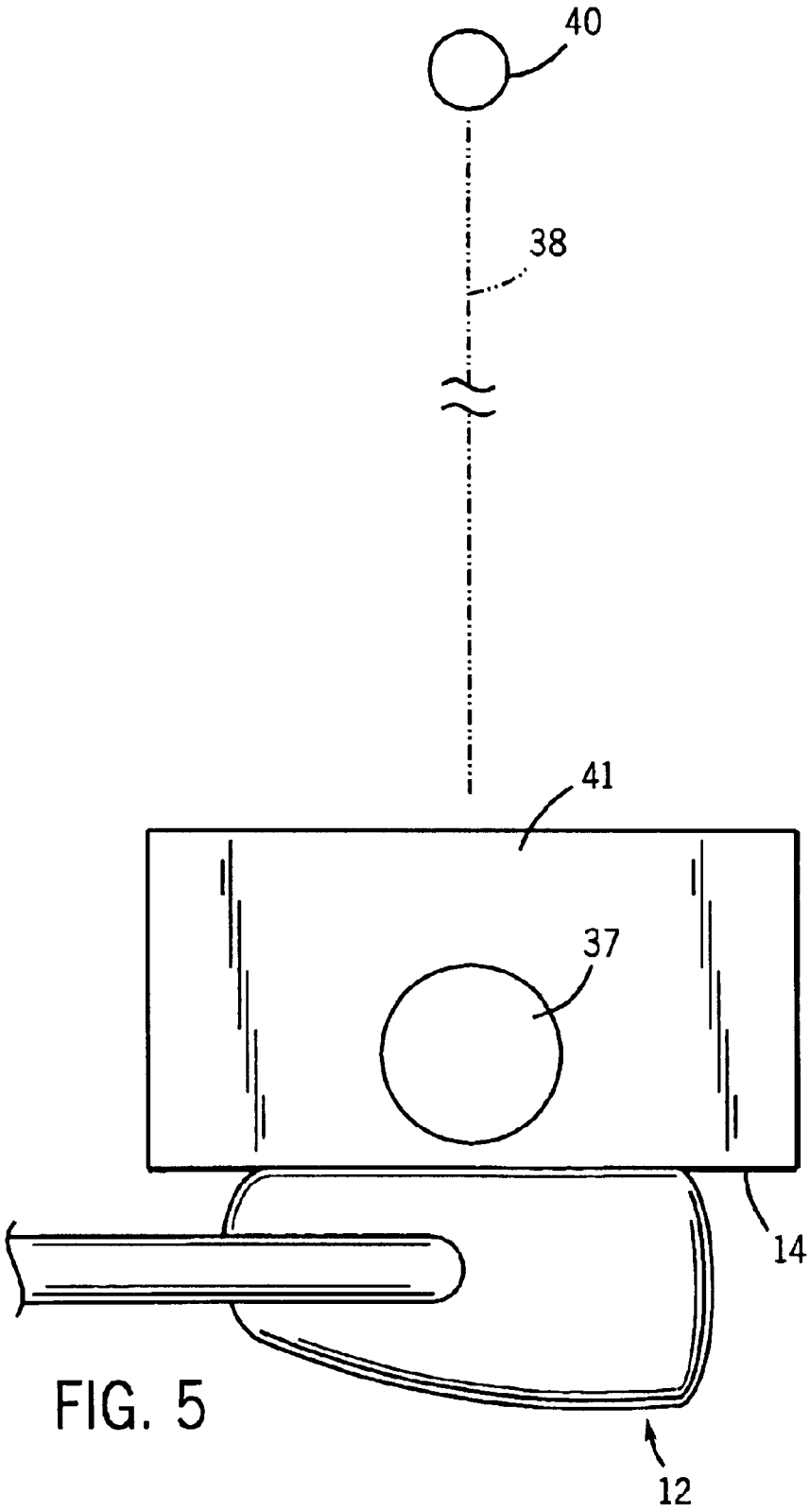
FIG. 5 is the putter head as viewed by the golfer when standing in the golfer's normal putting stance, the striking surface of head aligned against the substantially planar alignment surface and the alignment surface aligned perpendicular to an intended line of putt, in view of a target.

Referring now to FIG. 5, a further step of the method of the present invention may comprise aligning the alignment surface 14 perpendicular to an intended line of putt 38. The intended line of putt 38 represents a desired path for putting a ball to a target 40. It is preferable that the alignment surface 14 is aligned perpendicular to the intended line of putt 38 prior to the step of the golfer 2 placing the putter head 12 against the alignment surface 14. Aligning the alignment surface 14 in such a way helps the golfer 2 realize his or her normal putting stance prior to application of the alignment indicators 34, 36 and ensures that the putter head 12 is aligned perpendicular to the intended line of putt 38. It is also preferable for the alignment surface to comprise a marking 37 indicating the position of a ball which is located along the intended line of putt 38, thereby further helping the golfer 2 aligning the putter 2 relative to the intended line of putt 38. The marking 37 may comprise a circle having a diameter substantially equal to a standard golf ball. The marking 37 is also preferably placed proximate the intersection of the top surface 41 and the planar surface 14.

Figure 6:
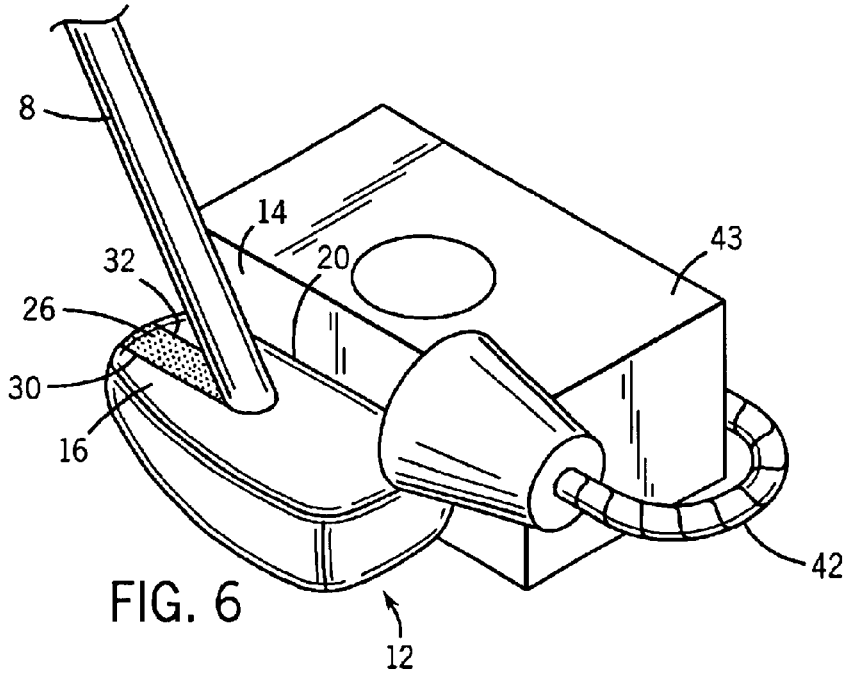
FIG. 6 is a view in perspective showing a light source coupled to the substantially planar alignment surface.

FIG. 6 illustrates a further embodiment of the method of the present invention. Rather than placing the light source 22 along the line of sight of the golfer 2 to be fitted (as shown in FIG. 1), a light source 42 is coupled to the alignment device 43 including the planar alignment surface 14. Once the golfer 2 to be fined places the striking surface 20 of the putter head 12 against the planar alignment surface 14, the light source 42 is adjusted to direct light across the putter shaft 8 and onto the heel portion 16 of the putter head 12. The position of the light source 42 is adjusted such that the shadow 26 having a first edge 30 and a second edge 32, as viewed by the golfer 2 when standing in the golfer's normal putting stance, appear adjacent to the shaft 8. Once the light source 42 has been properly adjusted, the indicators 34 and 36 are applied in the manner set forth previously.

Figure 7:
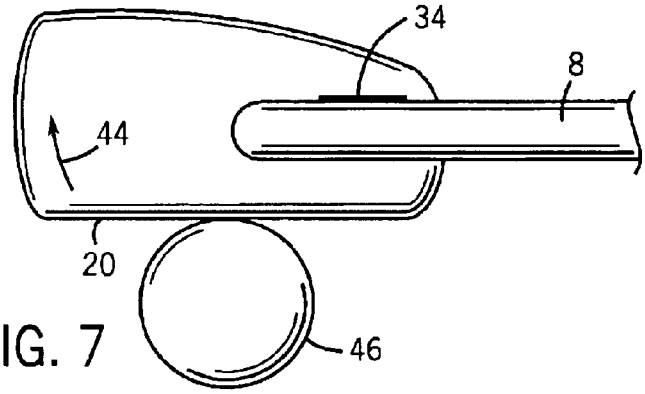
FIG. 7 is the putter head as viewed by the golfer when standing in the golfer's normal putting stance and the putter head improperly aligned.
Figure 8:
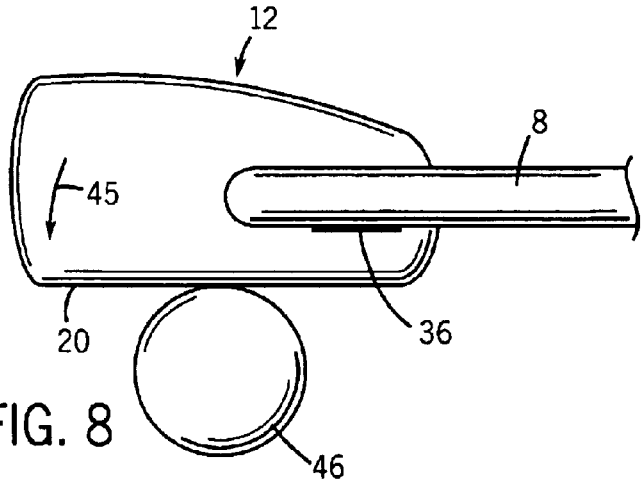
FIG. 8 is the putter head as viewed by the golfer when standing in the golfer's normal putting stance and the putter head improperly aligned.

Once the alignment indicators 34 and 36 have been applied to the putter head 12, as indicated in FIG. 4A, the putter can be used by the golfer to execute a proper putt. Referring now to FIG. 7, if the golfer takes a normal putting stance and looks down the shaft 8 to see only the single indicator 34 to the right of the shaft 8, the golfer must open the face 20 further for proper alignment as illustrated by the arrow 44. The putting face 20 is rotated as shown by arrow 44 until the golfer can no longer view the indicator mark 34. Once both indicator marks 34 and 36 are hidden behind the shaft 8, the golfer is sure that the putter face is properly aligned.

Likewise, if the golfer looks down the shaft 8 and sees only the indicator mark 36 to the left of the putter shaft 8, the face 20 must be closed by rotating the toe of the putter head in the direction shown by arrow 45. By rotating the putter head to close the face as illustrated by arrow 45, the golfer can be sure that the putter head 12 is properly aligned with the golf ball 46.

As can be understood by the above description, the method of the present invention allows for the application of the indicator 34 and 36 for each individual golfer, rather than the use of standard indicia to which the golfer must tailor his or her putting stroke. Thus, if the golfer has an unorthodoxed or unusual putting stance, the indicator 34 and 36 are applied based upon that putting stance. As long as the golfer continues to utilize the same normal putting stance, the indicator 34 and 36 will provide for proper alignment of the putting face.

It will thus be seen that certain changes may be made in the design and construction as set forth, without departing from the spirit and scope of the invention, and it is intended that all matter contained in this description and shown in the drawings shall be interpreted as illustrative and not in a limiting sense.

It will also be understood that the following claims are intended to cover all the generic and specific features of the invention herein described, and all statements of the scope of the invention, which as a matter of language, might be said to fall therebetween.

I claim:

1. A method of applying a putter alignment indicator to a putter to aid in aligning the putter during a putting stroke, the putter having an elongated shaft extending between a first end and a second end, and a putter head coupled to the second end of the shaft at a junction, the putter head having a striking surface and having a heel portion and a toe portion on opposite sides of the junction, the method comprising the steps of:

providing a substantially planar alignment surface;

having a golfer to be fitted grasp the first end of the club shaft while standing in the golfer's normal putting stance and place the striking surface of the putter head against the substantially planar alignment surface;

positioning a light source to direct a beam of light onto the elongated shaft to create a shadow having a first edge and a second edge on the heel portion of the putter head such that the first edge and the second edge of the shadow, as viewed by the golfer when standing in the golfer's normal putting stance, appear adjacent to the shaft; and placing the putter alignment indicator on the putter head adjacent to at least one edge of the shadow.

2. The method of claim 1 further comprising the step of aligning the alignment surface perpendicular to a target line.

3. The method of claim 2 wherein the target line extends from the alignment surface to a target.

4. The method of claim 1 wherein the light source is positioned at a point substantially parallel to the golfer's line of sight.

5. The method of claim 1 wherein the light source is coupled to the planar alignment surface.

6. The method of claim 1 wherein the substantially planar alignment surface indicates the position of a ball to be putted.

7. The method of claim 6, wherein the alignment surface has a substantially flat bottom and a top containing a marking representing a position of a ball.

8. The method of claim 7, wherein the marking representing the position of the ball is a circle having a diameter substantially equal to a diameter of a golf ball.

9. The method of claim 7, wherein the indication is positioned proximate the intersection of the top and the planar surface.

10. The method of claim 1, wherein the alignment indicator includes first and second spaced lines parallel to the first and second edges of the shadow, respectively.

11. The method of claim 10, wherein the spaced lines are hidden behind the shaft as viewed by the golfer when standing in the golfer's normal putting stance.

12. The method of claim 1 further comprising the step of: adjusting the position of the light source until the shadow is positioned directly below the shaft when the golfer is standing in the golfer's normal putting stance.

13. The method of claim 1, wherein the light source configured to be coupled to the head of the golfer.

14. A method of applying a putter alignment indicator to a putter to aid in aligning the putter during a putter stroke, the putter having an elongated shaft extending between a first end and a second end, and a putter head coupled to the second end of the shaft at a junction, the putter head having a striking surface and having a heel portion and a toe portion on opposite sides of the junction, the method comprising the steps of:

providing a substantially planar alignment surface;

aligning the alignment surface perpendicular to a target line;

having a golfer to be fitted grasp, the first end of the club shaft while standing in the golfer's normal putting stance and place the striking surface of the putter head against the substantially planar alignment surface;

positioning a light source to direct a beam of light onto the elongated shaft to create a shadow having a first edge and a second edge on the heel portion of the putter head;

adjusting the position of the light source such that the first edge and the second edge of the shadow, as viewed by the golfer when standing in the golfer's normal putting stance, appear adjacent to opposite sides of the shaft; and placing the alignment indicator on the putter head adjacent both the first edge and the second edge of the shadow.

15. The method of claim 14 wherein the target line extends from the alignment surface to a target.

16. The method of claim 14 wherein the light source is positioned at a point substantially parallel to the golfer's light of sight.

17. The method of claim 14 wherein the light source is coupled to the planar alignment surface.

18. The method of claim 14 wherein the planar alignment surface indicates the position of a ball to be putted.

19. The method of claim 18 wherein the alignment surface has a substantially flat bottom and a top containing a marking representing a position of a ball.

20. The method of claim 14 wherein the marking representing the position of the ball is a circle having a diameter substantially equal to the diameter of a golf ball.

21. The method of claim 14 wherein the indication is positioned proximate the intersection of the top and the planar surface.

22. The method of claim 14 wherein the alignment indicator includes first and second spaced lines parallel to the first and second edges of the shadow, respectively.

23. The method of claim 22 wherein the spaced lines are hidden behind the shaft when viewed by the golfer when standing in the golfer's normal putting stance.

24. The method of claim 14 wherein the light source configured to be coupled to a head of the golfer.

* * * * *